US007046123B1

(12) United States Patent
Goldberg

(10) Patent No.: US 7,046,123 B1
(45) Date of Patent: May 16, 2006

(54) PARKING METER KEY CHAIN TIMER

(76) Inventor: Rob Goldberg, 7238 SW. 52nd Ct., Miami, FL (US) 33143

( * ) Notice: Subject to any disclaimer, the term of this patent is extended or adjusted under 35 U.S.C. 154(b) by 50 days.

(21) Appl. No.: 10/750,509

(22) Filed: Dec. 31, 2003

(51) Int. Cl.
*G08B 1/00* (2006.01)

(52) U.S. Cl. ..... 340/309.8; 116/308; 368/90; 368/249; 368/250; 368/279; 340/932.2

(58) Field of Classification Search ..... 340/932.2, 340/309.3, 309.16, 309.4, 309.2, 309.5, 309.7, 340/309.8; 116/245, 254, 284, 290, 308, 116/309, DIG. 44; 368/71, 72, 80, 90, 98, 368/99, 107, 108, 109, 224, 228, 244, 249, 368/250, 266, 278, 279, 281, 238, 232
See application file for complete search history.

(56) References Cited

U.S. PATENT DOCUMENTS

| | | | | |
|---|---|---|---|---|
| 2,596,374 A | | 5/1952 | Crapster | 116/133 |
| 3,016,641 A | | 1/1962 | Lepinay et al. | 40/70 |
| 3,555,809 A | * | 1/1971 | Michael | 368/99 |
| 4,005,571 A | | 2/1977 | Wolff | 58/39.5 |
| 4,637,732 A | | 1/1987 | Jones et al. | 368/109 |
| 4,641,125 A | | 2/1987 | Pesa | 340/309.15 |
| 4,879,553 A | | 11/1989 | Righi | 340/932.2 |
| 5,266,947 A | | 11/1993 | Fujiwara et al. | 340/932.2 |
| 5,589,812 A | | 12/1996 | Jones | 340/309.15 |
| 6,114,953 A | | 9/2000 | Martin | 340/457 |
| 6,400,358 B1 | | 6/2002 | Carter | 345/169 |
| 2004/0075581 A1 | * | 4/2004 | Staniszewski | 340/932.2 |

FOREIGN PATENT DOCUMENTS

| | | |
|---|---|---|
| WO | WO02080114 | 10/2002 |

* cited by examiner

*Primary Examiner*—Brent A. Swarthout
(74) *Attorney, Agent, or Firm*—Michael I Kroll

(57) ABSTRACT

The present invention is a parking time indicator key fob which includes a housing and a timing device contained within the housing for counting down an amount of time. A display is connected to the housing for indicating an amount of time remaining on the timing device. The present invention further includes a means for setting the timing device to the amount of time and an alarm mechanism is connected to the timing device. Upon setting the setting means to the amount of time, the timing device is activated causing the timing device to count down from the amount of time value to a zero value. Upon reaching a predetermined value, the timing device causes the alarm mechanism to be activated thereby alerting a user that the amount of time is approaching the zero value.

6 Claims, 10 Drawing Sheets

PARKING METER KEY CHAIN TIMER

BACKGROUND OF THE INVENTION

1. Field of the Invention

The present invention relates generally to pocket key fobs, and more particularly to a pocket key fob connected to a key chain. The key fob includes a parking time indicator for tracking time remaining on a parking meter. A dial is located on the face of the key fob, and upon turning the dial, a pin is set into motion for indicating the current time remaining on a parking meter. A timing device causes the pin to move gradually in the direction of zero value. When the pin reaches a predetermined time value, a plurality of alarm mechanisms are activated notifying the user that more coins need to be inserted in order to avoid a parking violation. The alarm mechanisms can be at least one of audible, visual, and vibrational. In an alternate embodiment, control button(s) provide means to set, start, and stop the timer module in lieu of a dial.

2. Description of the Prior Art

Numerous other types of key fob devices, parking-time indicators, and alarms exist in the prior art. Typical of these are U.S. Pat. Nos. 2,596,374, 3,016,641, 4,005,571, 4,637,732, 4,641,125, 4,879,553, 5,266,947, 5,589,812, 6,114,953, 6,400,358, Japanese Patent No. 20011338339 and International Publication No. WO 02/80114. While these devices may be suitable for the purposes for which they were designed, they would not be as suitable for the purposes of the present invention, as hereinafter described.

The invention relates to pocket key holders of the type used for automobile keys, and more particularly to time indicating means associated therewith.

This invention relates to rear view mirrors and has specific reference to a rear view mirror constituting at the same time a parking-time indicator intended for use notably in those zones of heavy-traffic towns where parking periods are strictly limited by police regulations.

An elapsed time display and reminder device that is manually adjustable by the user to select a time in the future that may be many days in advance of the present, and to provide a calibrated countdown display of the progressively diminishing time interval until the selected future time is reached. In a preferred device, the user enters the present time and the future time in calendar form as a month and day of the month, and the device automatically converts this future calendar date less the present date, into an elapsed time interval as a number of days.

A sports timing device for referees, officials, umpires, coaches and the like. The timer is ideally adapted for football or basketball officiating and it contains circuit means for generating necessary timing signals for officiating the game. The circuit is initiated manually by depression of a primary switch, and timing alarm signals generated by the circuit actuate tactile stimulation means to vibrate the device enclosure to warn the referee or official without the necessity of him visually observing the apparatus. In the football mode the device preferably provides an alarm after expiration of twenty-five seconds. In the basketball mode the device provides three second, five second and ten second warnings. Low battery signaling means are incorporated in the circuitry for immediately warning the user that the battery is weak prior to commencing a timing operation; also, an LED provides an immediate dead battery warning. The enclosure of the device is preferably symmetrically configured to readily adapt the timer for use by either the left or right hand, and preferably the timer is suspended from the wearer's wrist until the unit is actually needed. Alternatively the timer may be suspended from the user's waist.

A meter beater timer is provided which alerts the user when a predetermined time interval has expired so that he can return to the meter and deposit additional coins if necessary. Unlike previous timers, the user is reminded to set the timer when he withdraws the ignition key from the ignition. The key is attached to a key ring and to a key chain, which retracts into the timer housing when the key is removed from the ignition depressing a plunger, which sets off an alarm. An electronic version and a mechanical version are provided.

A telecontrol system for a motor vehicle (1) includes receiver (2) and transmitter (3). The receiver (2) is incorporated in the rearview mirror (4) of a motor vehicle (1) and includes an electronic digital clock whose display (5) is provided on the back of the mirror and can be viewed through the windshield. The transmitter (3) controls also the electric actuators (8) for locking and unlocking doors of the vehicle (1), and the anti-theft device. The transmitter is of pocket size and comprises an electronic minute-counter with respective display (15). Through the provision of a control key (13) on the transmitter (3), the indication of the time is made visible and locked on the display (5) of the electronic clock of the receiver (2), and at the same time the minute-counter of the transmitter (3) is started. Two further control keys (11, 12) on the transmitter (3) enable the door-locks of the motor vehicle (1) to be unlocked and locked, and the anti-theft device (17) to be deactivated and activated. A further control key (14) on the transmitter (3) serves to reset the minute-counter to zero and—when the engine of the motor vehicle is started—to blank off the display (5) of the electronic clock of the receiver (2).

A parking data transfer system has first and second communications devices. The first communications devices each include a timing device, a first display for displaying a parking time and first transmitter for transmitting a notification when the time measured by the timing device has reached the parking time. The second communications devices each include a notifying device for notifying receipt of the notification transmitted by the first transmitter. The first communications device modifies the parking time on receipt of an updating signal transmitted by the second communications device.

A portable timing device designed for use in conjunction with metered machinery, the device contained within a compact case with a clip on the back side, allowing the device to be fastened to an article of clothing or the like. The case further includes a means to store and dispense a plurality of coins for use in the meter, and an external actuation means by which the appropriate time interval is programmed. An electrical circuit is enclosed within the case, the circuit powered by a rechargeable battery, which is connected to a solar energy collection device for recharging it. The circuit programs and times the selected time interval, and emits an audible warning signal when ten minutes, five minutes, and no time remain in the time interval.

A reminder device for vehicle key rings or the like includes an integrated processor programmable to provide reminder information in a plurality of operating modes comprising mileage, date, parking location, parking meter expiration, event status and lost key recovery assist.

A portable electronic parking location reminder device that may be easily carried on a key chain or key ring has an electronic display screen and contains a battery powered microcontroller with memory and timer features. User input keys on the housing allow the user to enter letters and/or numbers corresponding to the location of a parked vehicle, store the entered data, and later retrieve and display the data when it is desired to find the parked vehicle. The user input keys include a mode key for selecting between an alpha mode for entering letters of the alphabet (A–Z), a numeric mode for entering numerals (0–9), and a direction mode for entering letters representing geographical directions (N, NE, E, SE, S, SW, W). Data is entered and displayed in several distinct fields that correspond to an aspect of the location of the parked vehicle. The identity of a parking lot in which the vehicle is parked may be entered in a first field, the identity of a row of a parking area entered in a second field, the identity of a floor level of a parking facility in a third field, and the identity of a geographical location of a parking area in a fourth field. Stored data may be selectively locked to prevent accidental changing. An automatic reduced power mode reduces power consumption when not in use, and a low battery condition is also displayed.

PROBLEM TO BE SOLVED: To effectively urge a user to pay a bicycle parking charge in spite of being capable of suppressing the installing cost as for an unpaid charge warning system in a bicycle parking lot where bicycle parking is charged though there is no means for confining bicycles.

SOLUTION: The system is provided with a lock 10 and an unpaid bicycle parking charge display panel 12 to be fitted to the main body 14 of the lock. The lock is mounted to the part of the bicycle which is easy to see in the case of observing from outside so as to avoid being removed from the part without unlocking. Thus, unpaid bicycle parking charge is warned to the owner of the bicycle by the panel 12 fitted to the main body of the lock.

The present invention discloses a car parking record display device which comprises a control circuit, timer, deposit card detector, timing display means, input key, power supply, shell, password memory, area display means and parking fees rate display means. The deposit card detector can be physically connected with the deposit card. The deposit card detector is connected with the control circuit. The control circuit can read and change information in the deposit card by the deposit card detector. The control circuit is connected with the timer. After the information obtained from the deposit card is processed, the timer starts to time. The output of timer is connected with the timing display means. The timing display means displays the time of timer. The car parking record display device is used instead of the stand parking meter, so as to reduce the investment of setting up park and high maintenance fee and to overcome the shortage of lacking flexibility.

SUMMARY OF THE PRESENT INVENTION

The present invention relates generally to pocket key fobs, and more particularly to a pocket key fob connected to a key chain. The key fob includes a parking time indicator for tracking time remaining on a parking meter. A dial is located on the face of the key fob, and upon turning the dial, a pin is set into motion for indicating the current time remaining on a parking meter. A timing device causes the pin to move gradually in the direction of zero value. When the pin reaches a predetermined time value, a plurality of alarm mechanisms are activated notifying the user that more coins need to be inserted in order to avoid a parking violation. The alarm mechanisms can be at least one of audible, visual, and vibrational.

A primary object of the present invention is to provide a parking time indicator that overcomes the shortcomings of the prior art.

A secondary object of the present invention is to provide a parking time indicator formed as a key fob.

Another object of the present invention is to provide a parking time indicator having a dial connected to a timing device within the key fob.

A further object of the present invention is to provide a parking time indicator having control button(s) connected to a timing device within the key fob.

A still further object of the present invention is to provide a parking time indicator wherein the timing device includes a pin.

Yet another object of the present invention is to provide a parking time indicator wherein the pin indicates the time remaining on a parking meter.

Another object of the present invention is to provide a parking time indicator having numerical values for determining the amount of time remaining on the timing device.

A further object of the present invention is to provide an alarm mechanism attached internally to the timing device.

A further object of the present invention is to provide an alarm mechanism attached internally to the timing device wherein the alarm mechanism is an audible alarm.

A further object of the present invention is to provide an alarm mechanism attached internally to the timing device wherein the alarm mechanism is a visual alarm.

A further object of the present invention is to provide an alarm mechanism attached internally to the timing device wherein the alarm mechanism is a vibrational alarm.

An even further object of the present invention is to provide a parking time indicator wherein the alarm mechanism is activated within a predetermined period prior to the time on the timing device reaches zero value, notifying the user that coins should be inserted into a parking meter to avoid a parking violation.

Still yet a further object of the present invention is to provide a parking time indicator wherein the alarm mechanism is activated when the time on the timing device reaches a zero value, notifying the user that coins should be inserted into a parking meter to avoid a parking violation.

Still another object of the present invention is to provide a parking time indicator simple and easy to use.

Still yet another object of the present invention is to provide a parking time indicator that is inexpensive to manufacture and use.

Additional objects of the present invention will appear as the description proceeds.

The present invention overcomes the shortcomings of the prior art by providing a parking time indicator that is in the form of an actual parking meter for reminding users of the time remaining in a parking meter. The parking time indicator is formed as a key fob and is connected to a key ring. The key fob includes a dial, which is internally attached to a timing device. A time indicator pin may be connected directly to the dial or indirectly to the internal timing device. The pin corresponds to the amount of time remaining on the internal timing device by aligning with numerical indicators positioned on the key fob. The key fob includes an alarm mechanism connected to the timing device. The alarm mechanism is triggered when the timing device reaches at least one of a first value and a zero value. The alarm reminds the user to insert more coins into the parking meter.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
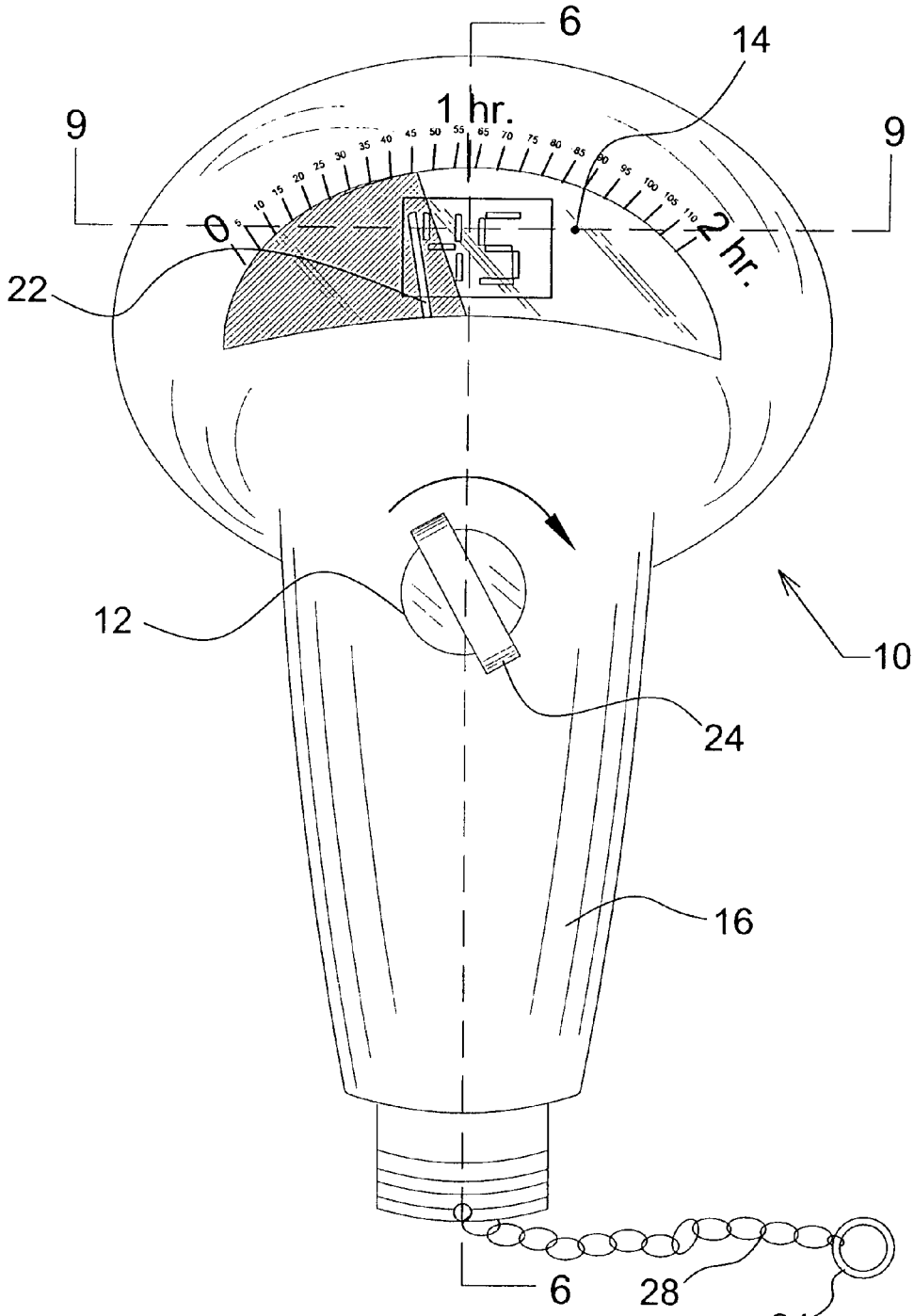
FIG. 1 is a front view of the parking time indicator key fob of the present invention.

Turning now descriptively to the drawings, in which similar reference characters denote similar elements throughout the several views, the Figures illustrate the parking time indicator key fob of the present invention. With regard to the reference numerals used, the following numbering is used throughout the various drawing Figures.

10 parking time indicator key fob of the present invention
12 dial central body member
14 window or display (in alternate views in FIGS. 2 and 3)
16 main body member
22 indicator pin
24 dial grip body member
28 chain
30 control button
32 pin slot
34 key ring
36 timing device
38 alarm device
40 power source
49 parking meter
50 user

DETAILED DESCRIPTION OF THE PREFERRED EMBODIMENT

The following discussion describes in detail one embodiment of the invention and several variations of that embodiment. This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 10 illustrate the parking time indicator key fob of the present invention indicated generally by the numeral 10.

Figure 5:
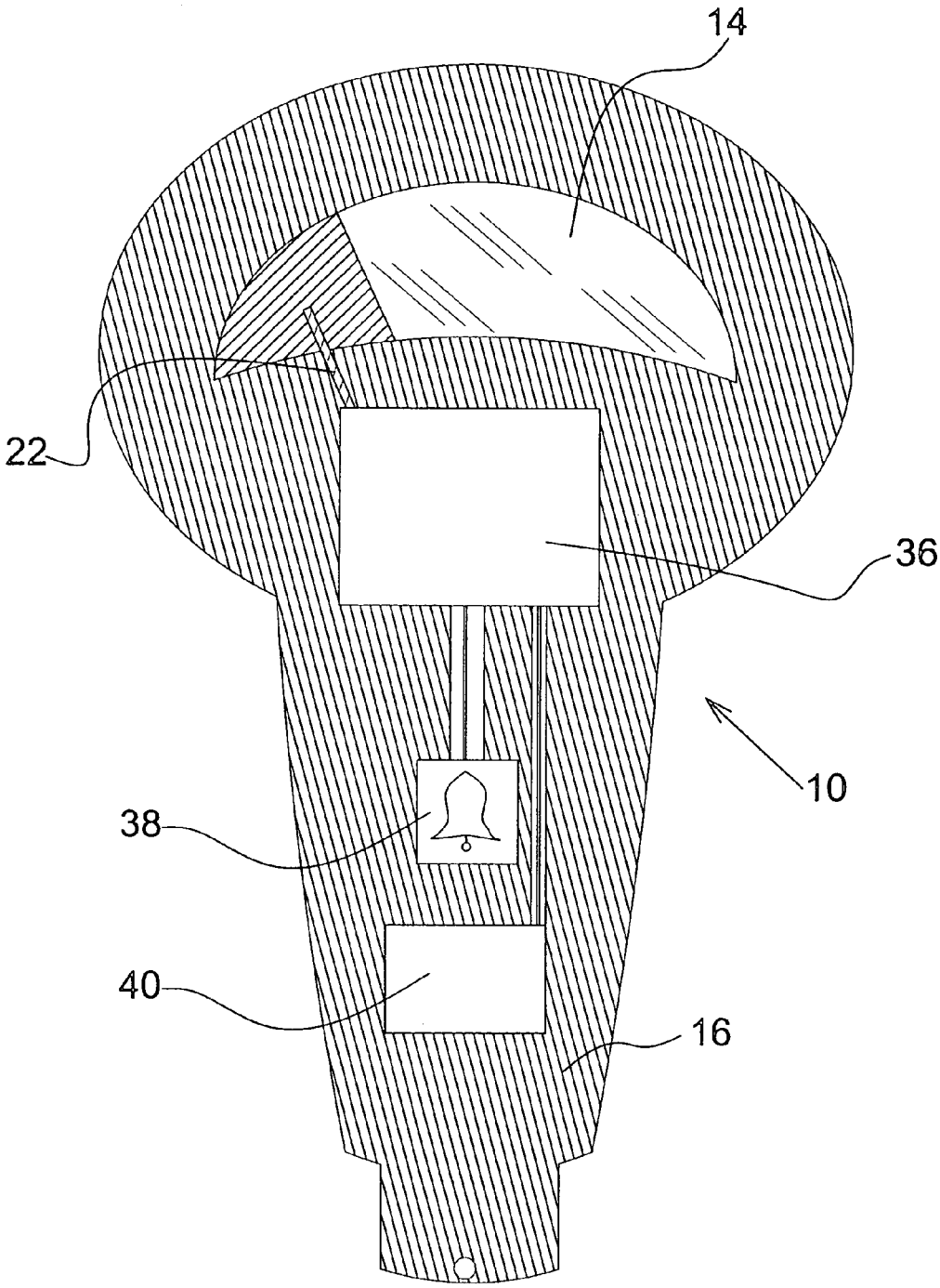
FIG. 5 is a cut-away view of the parking time indicator key fob of the present invention.
Figure 6:
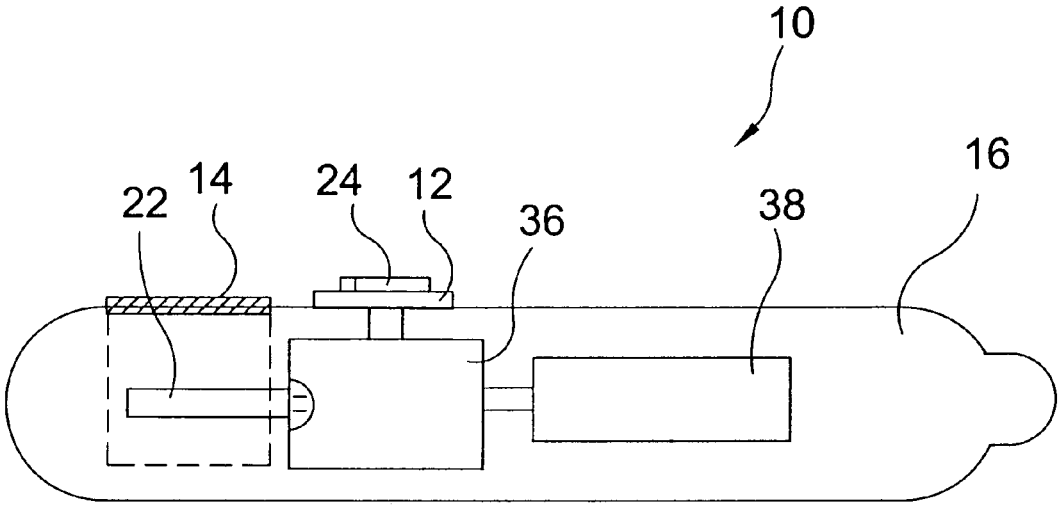
FIG. 6 is a side cross-sectional view of the parking time indicator key fob of the present invention taken along line 6—6 in FIG. 1.

FIG. 1 is a front view of the parking time indicator key fob 10 of the present invention. The parking time indicator key fob 10 includes a main body member 16 and a window or display 14 therein. Preferably, the main body member 16 is shaped as a parking meter, but the main body member 16 may be formed in any shape. The main body member 16 is connected to a chain 28. The chain 28 is connected to a key ring 34 for connecting the parking time indicator key fob 10 to a set of keys. The parking time indicator key fob 10 includes a dial central body member 12. The dial central body member 12 is connected internally to a timing device 36, as shown in FIGS. 5 and 6. The dial grip body member 24 is connected to the dial central body member 12 to allow a user to manipulate the dial and therefore the timing mechanism contained therein. An indicator pin 22 is connected internally to the timing device, also as shown in FIGS. 5 and 6. Preferably, the main body member 16 includes numerical indicia imprinted thereon. When a user manipulates the dial grip body member 24, the timing mechanism is activated. The amount of time remaining on the timing device is indicated by the position of the indicator pin 22 in relation to the numerical indicia. When the timing mechanism reaches a predetermined level, an alarm mechanism is sounded, thereby reminding the user that the parking meter at which he parked the car is about to expire, and that additional coins should be inserted to avoid a parking violation.

Figure 2:
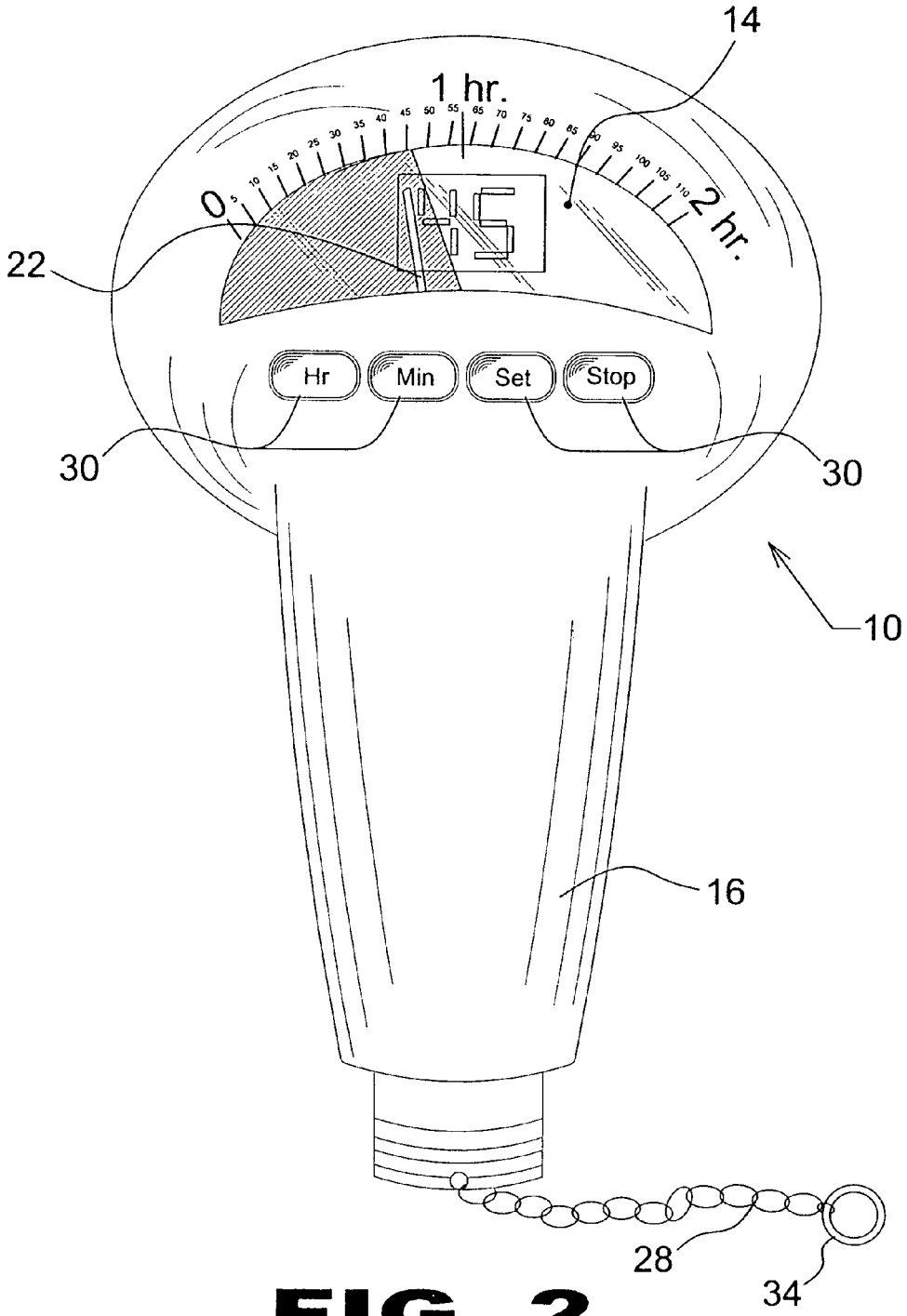
FIG. 2 is a front view of an alternate embodiment of the parking time indicator key fob of the present invention.

FIG. 2 is a front view of an alternate embodiment of the parking time indicator key fob 10 of the present invention. The parking time indicator key fob 10 includes the main body member 16 and the window or display 14 therein. Preferably, the main body member 16 is shaped as a parking meter, but the main body member 16 may be formed in any shape. The main body member 16 is connected to the chain 28. The chain 28 is connected to the key ring 34 for connecting the parking time indicator key fob 10 to a set of keys. The parking time indicator key fob 10 includes control buttons 30 for controlling the timing device contained therein. In a preferred embodiment, the control buttons 30 includes at least one of an hour button, a minute button, a set button, and a stop button. Preferably, an indicator pin 22 is connected internally to the timing device, as shown in FIGS. 5 and 6. The main body member 16 further includes numerical indicia imprinted thereon. When a user presses a control button 30, the timing mechanism is activated. The amount of time remaining on the timing device is indicated by the position of the indicator pin 22 in relation to the numerical indicia. When the timing mechanism reaches a predetermined level, an alarm mechanism is sounded, thereby reminding the user that the parking meter at which he parked the car is about to expire, and that additional coins should be inserted to avoid a parking violation.

Figure 3:
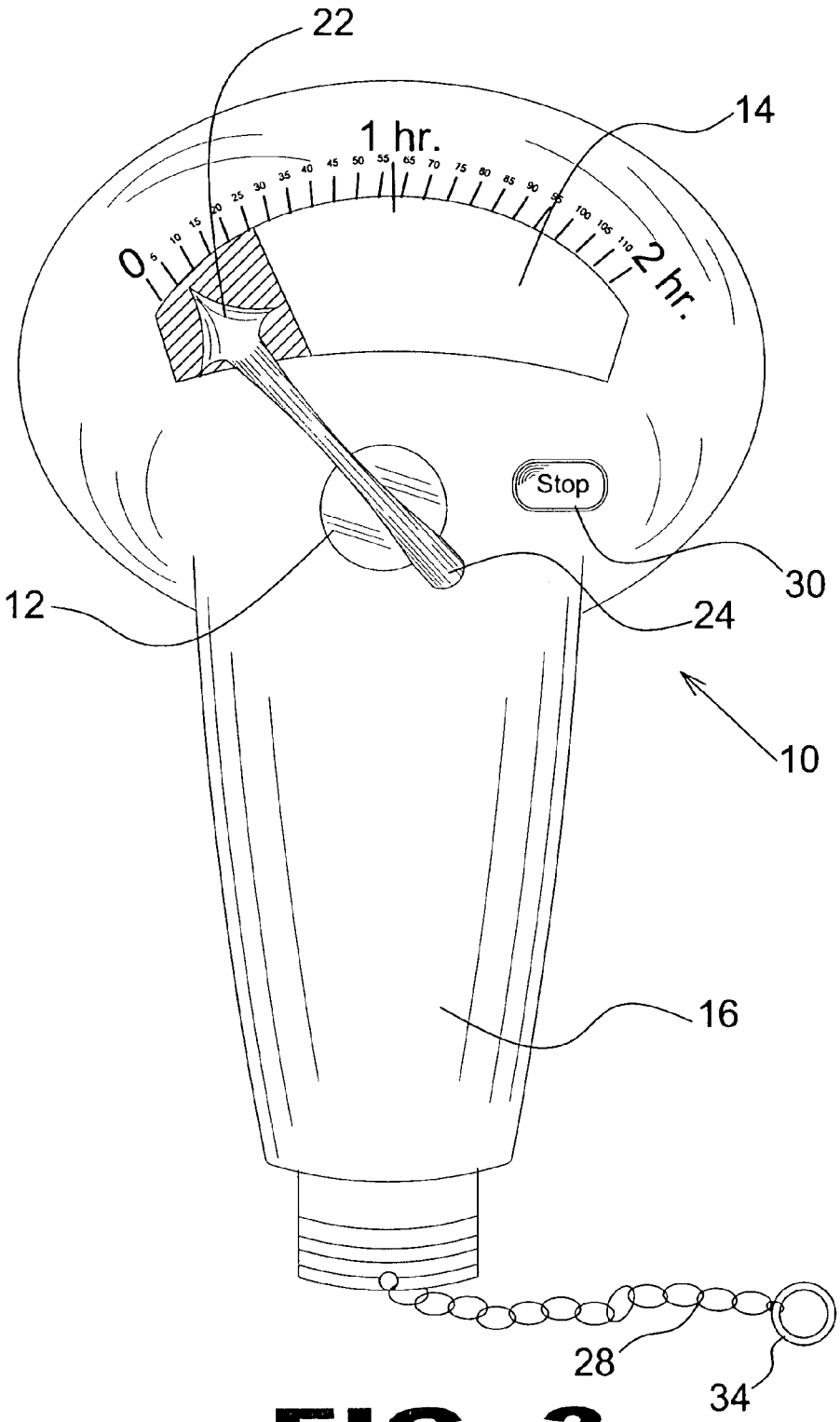
FIG. 3 is a front view of an alternate embodiment of the parking time indicator key fob of the present invention.

FIG. 3 is a front view of an alternate embodiment of the parking time indicator key fob of the present invention. The parking time indicator key fob 10 includes the main body member 16 and the window or display 14 therein. Preferably, the main body member 16 is shaped as a parking meter, but the main body member 16 may be formed in any shape. The main body member 16 is connected to the chain 28. The chain 28 is connected to the key ring 34 for connecting the parking time indicator key fob 10 to a set of keys. The parking time indicator key fob 10 includes the dial central body member 12. The dial central body member 12 is connected internally to the timing device 36, as shown in FIGS. 5 and 6. The dial grip body member 24 is connected to the dial central body member 12 to allow a user to manipulate the dial and therefore the timing mechanism contained therein. The indicator pin 22 is connected to the dial grip body member 24 of the parking time indicator key fob 10 wherein the display 14 does not include a window bubble, as shown in FIG. 1. Preferably, the main body member 16 includes numerical indicia imprinted thereon. When a user manipulates the dial grip body member 24, the timing mechanism is activated. The amount of time remaining on the timing device is indicated by the position of the indicator pin 22 in relationship to the numerical indicia. When the timing mechanism reaches a predetermined level, an alarm mechanism is sounded, thereby reminding the user that the parking meter at which he parked the car is about to expire, and that additional coins should be inserted to avoid a parking violation.

Figure 4:
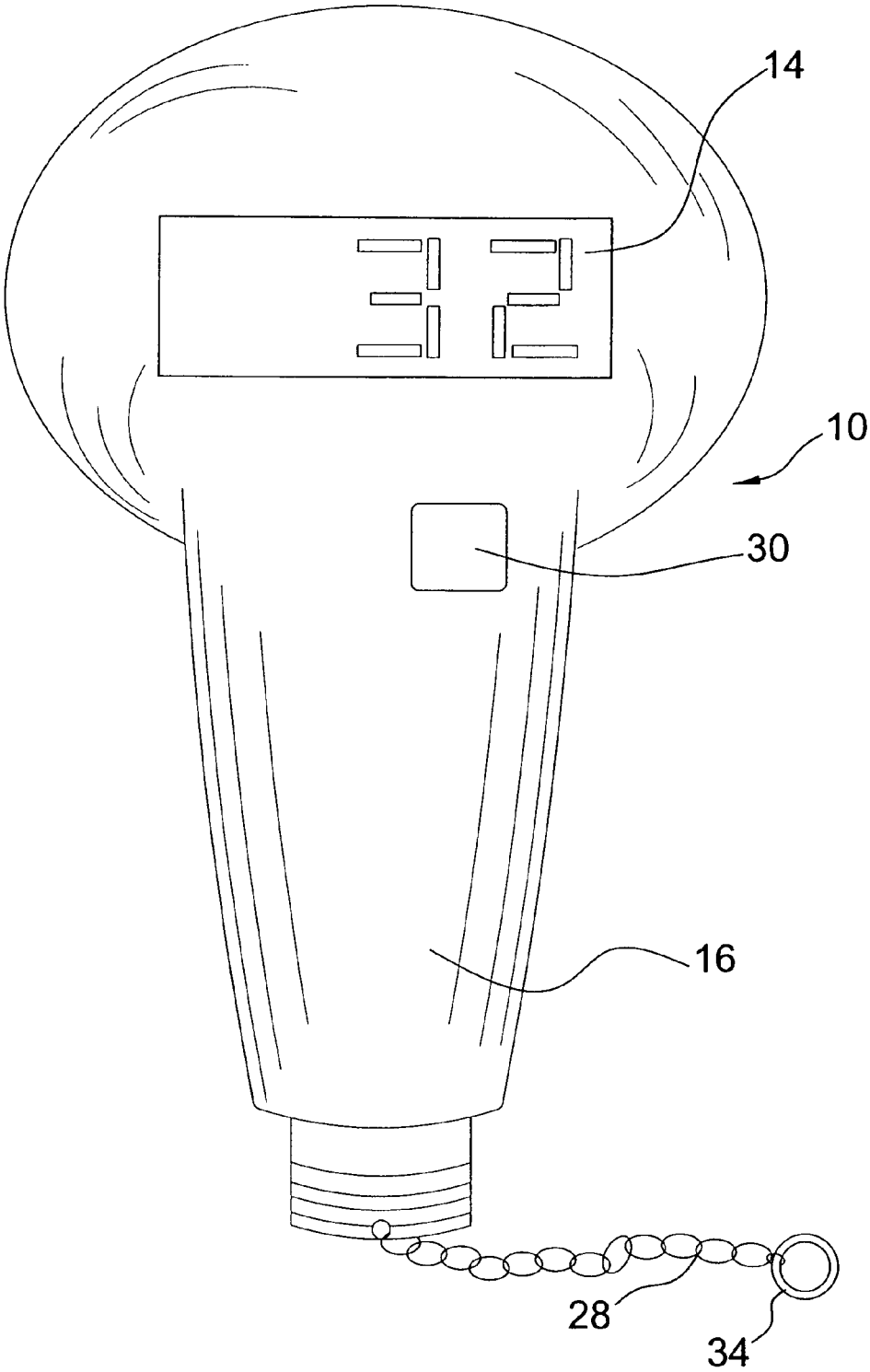
FIG. 4 is a front view of an alternate embodiment of the parking time indicator key fob of the present invention.

FIG. 4 is a front view of an alternate embodiment of the parking time indicator key fob of the present invention. The parking time indicator key fob 10 includes the main body member 16 and the window or display 14 therein. Preferably, the main body member 16 is shaped as a parking meter, but the main body member 16 may be formed in any shape. The main body member 16 is connected to the chain 28. The chain 28 is connected to the key ring 34 for connecting the parking time indicator key fob 10 to a set of keys. The parking time indicator key fob 10 includes a control button 30 for controlling the timing device contained therein. When a user presses a control button 30, the timing mechanism is activated. The amount of time remaining on the timing device is indicated by a screen illuminated with light emitting diodes. When the timing mechanism reaches a predetermined level, an alarm mechanism is sounded, thereby reminding the user that the parking meter at which he parked the car is about to expire, and that additional coins should be inserted to avoid a parking violation.

FIG. 5 is a cut-away view of the parking time indicator key fob of the present invention. The parking time indicator key fob 10 includes the main body member 16 in the shape of a parking meter and the window or display 14. Preferably, the main body member 16 includes numerical indicia imprinted thereon, as shown in FIGS. 1–3. The parking time indicator key fob 10 includes the timing device 36. The timing device 36 is connected to an alarm mechanism 38. A power source 40 is connected to the timing device 36 for providing power to the key fob 10. An indicator pin 22 is connected internally to the timing device. When a user manipulates a control device located on the outside of the parking time indicator key fob, the timing mechanism is activated. The timing device 36 causes the indicator pin 22 to move gradually in the direction of zero value. The amount of time remaining on the timing device is indicated by the position of the indicator pin 22 in relation to the numerical indicia. When the timing mechanism 36 reaches a predetermined level, the timing mechanism 36 causes the alarm mechanism 38 to emit a sound, thereby reminding the user that the parking meter at which he parked the car is about to expire, and that additional coins should be inserted to avoid a parking violation.

FIG. 6 is a side cross-sectional view of the parking time indicator key fob of the present invention taken along line 6—6 in FIG. 1. The parking time indicator key fob 10 includes a main body member 16 in the shape of a parking meter and a window or display 14. The parking time indicator key fob 10 includes a timing device 36. The timing device 36 is connected to an alarm mechanism 38. The parking time indicator key fob 10 includes a dial central body member 12. The dial central body member 12 is connected internally to the timing device 36. The dial grip body member 24 is connected to the dial central body member 12 to allow a user to manipulate the dial and therefore the timing device 36 contained therein. The indicator pin 22 is connected internally to the timing device 36. When a user manipulates a control device located on the outside of the parking time indicator key fob 10, the timing mechanism is activated. The timing device 36 causes the indicator pin 22 to move gradually in the direction of zero value. The amount of time remaining on the timing device is indicated by the position of the indicator pin 22 in relationship to numerical indicia imprinted on the outside of the parking time indicator key fob 10. When the timing mechanism 36 reaches a predetermined level, the timing device 36 causes the alarm mechanism 38 to emit a sound, thereby reminding the user that the parking meter at which he parked the car is about to expire, and that additional coins should be inserted to avoid a parking violation.

Figure 7:
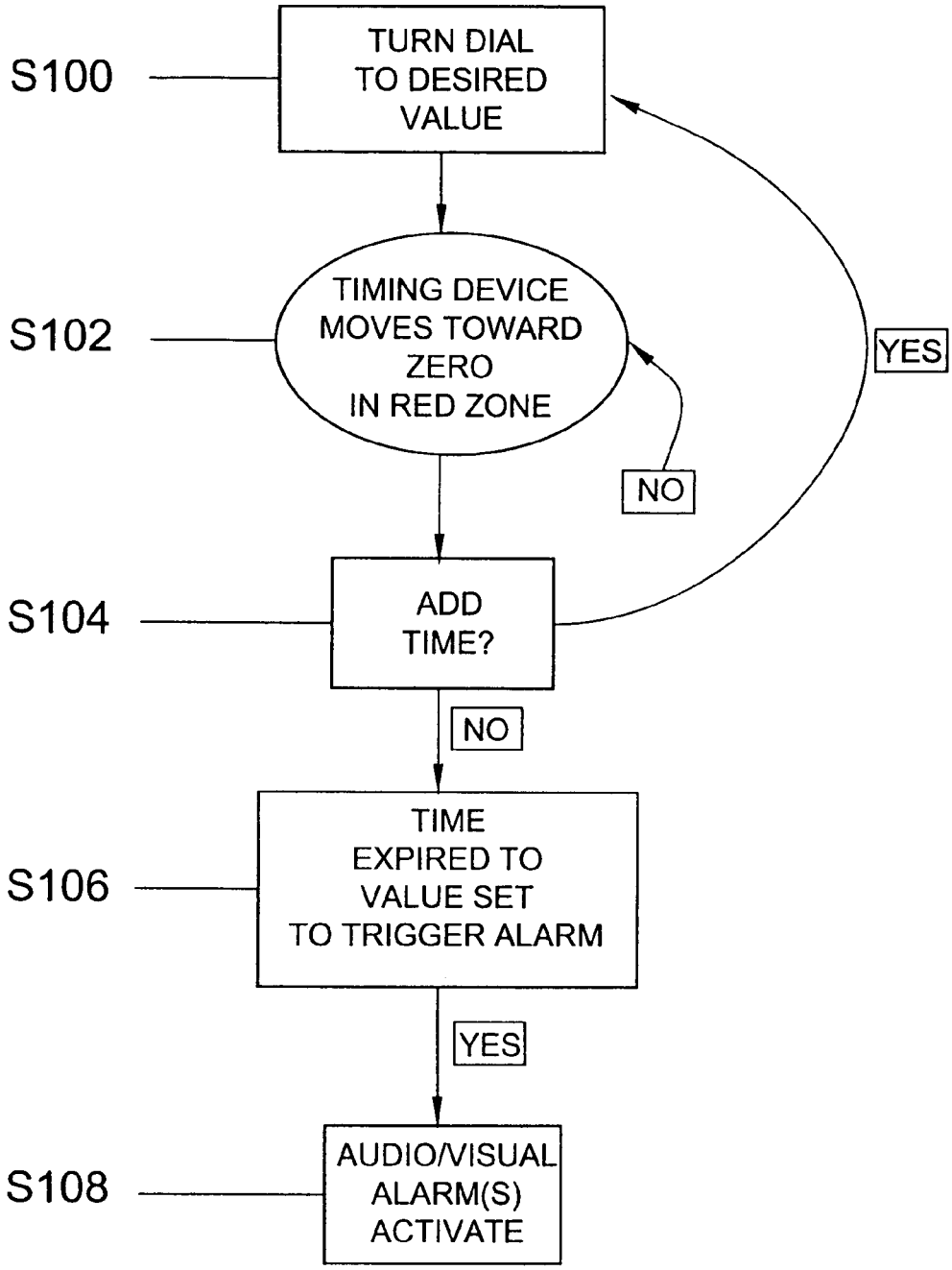
FIG. 7 is a flow diagram of the parking time indicator key fob illustrating the use of the present invention.

FIG. 7 is a flow diagram of the parking time indicator key fob illustrating the use of the present invention. The user first inserts coins in a parking meter and turns the dial to a desired value equal to the value remaining on the parking meter, as shown in step S100. The timing device moves toward a zero value in real time, as shown in step S102. If the user wishes to add time by inserting more coins in the parking meter, as shown in step S104, then the user repeats step S100, and turns the dial to the new desired value. When the timer reaches the predetermined value set to trigger the alarm, as shown in step S106, then the alarm activates, as shown in step S108. Preferably, the alarm is at least one of audio, visual, and vibrational.

Figure 8:
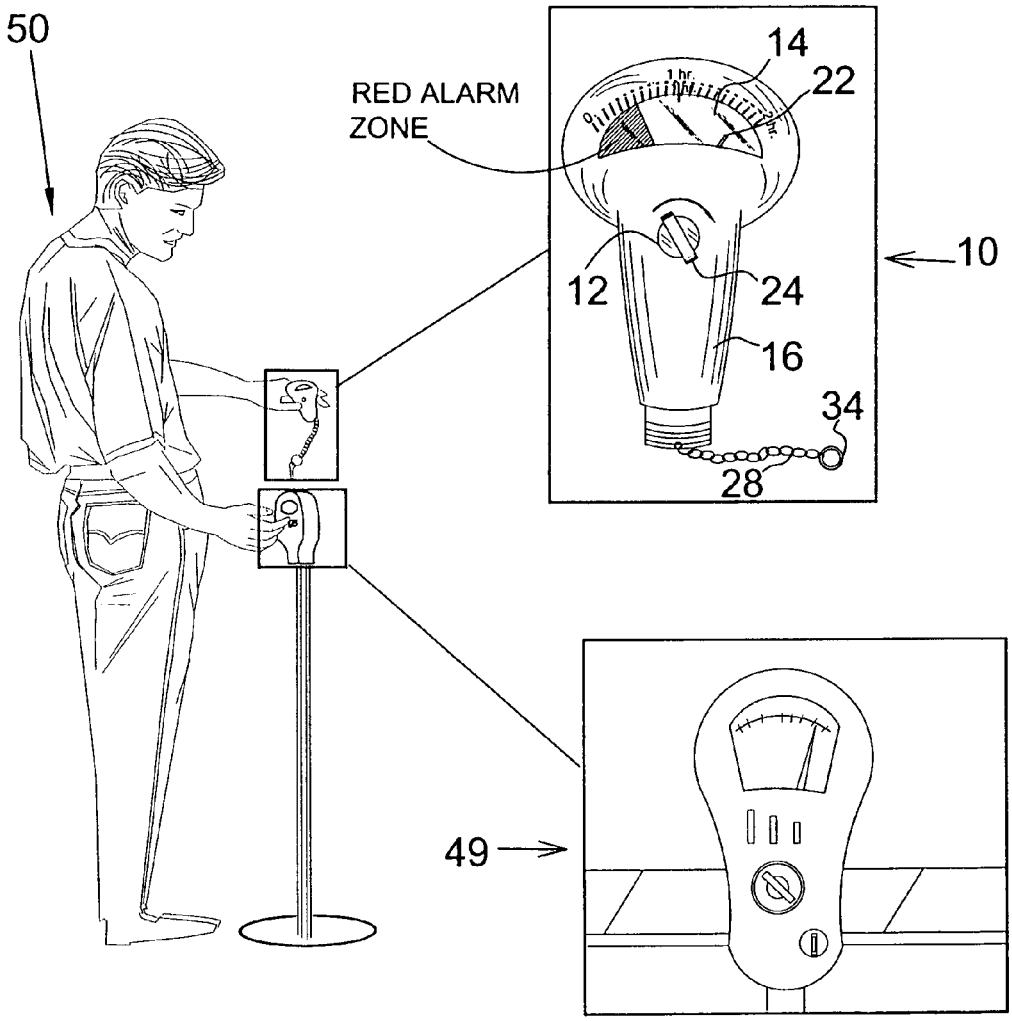
FIG. 8 is an illustration of use of the parking time indicator key fob.

FIG. 8 is an illustration of use of the parking time indicator key fob 10 of the present invention. Shown is a user 50 inserting coins in a parking meter 49. The user 50 is also holding the parking time indicator key fob 10 of the present invention. The parking time indicator key fob 10 includes the main body member 16 in the shape of a parking meter and the window or display 14. The main body member 16 is connected to the chain 28. The chain 28 is connected to the key ring 34 for connecting the parking time indicator key fob 10 to a set of keys. The parking time indicator key fob 10 includes a dial central body member 12. The dial central body member 12 is connected internally to a timing device 36, as shown in FIGS. 5 and 6. The dial grip body member 24 is connected to the dial central body member 12 to allow a user to manipulate the dial and therefore the timing mechanism contained therein. An indicator pin 22 is connected internally to the timing device, as shown in FIGS. 5 and 6. Preferably, the main body member 16 includes numerical indicia imprinted thereon. Preferably, the user manipulates the dial grip body member 24 to set the parking time indicator key fob 10 at a time value equal to the time remaining on the parking meter 49. Upon manipulating the dial grip body member 24, the timing mechanism is activated. The amount of time remaining on the timing device is indicated by the position of the indicator pin 22 in relationship to the numerical indicia. When the timing mechanism reaches a predetermined level, an alarm mechanism is sounded, thereby reminding the user that the parking meter at which he parked the car is about to expire, and that additional coins should be inserted to avoid a parking violation.

Figure 9:
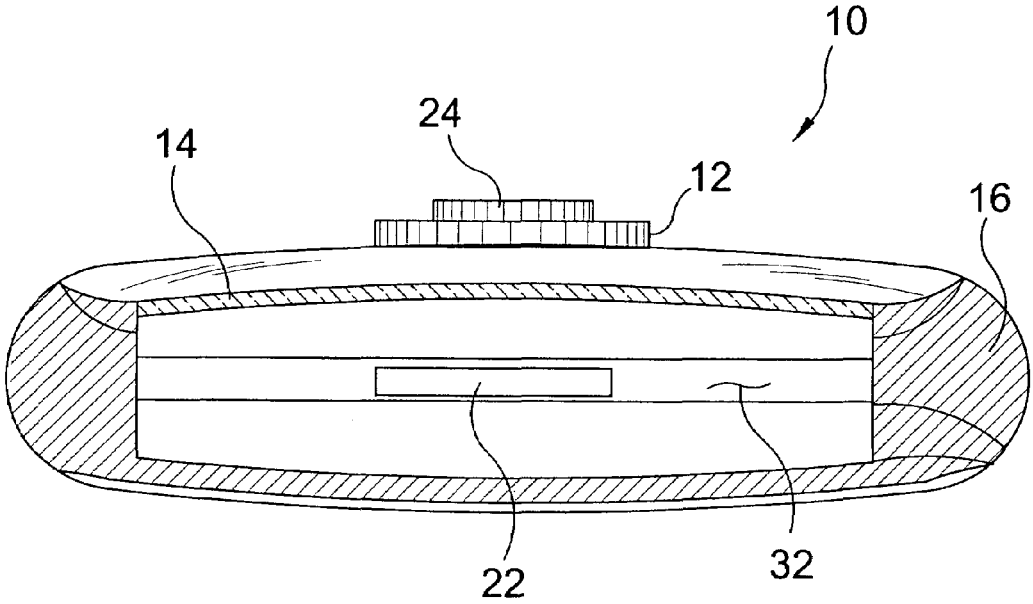
FIG. 9 is a top cross-sectional view of the parking time indicator key fob of the present invention taken along line 9—9 in FIG. 1.

FIG. 9 is a top cross-sectional view of the parking time indicator key fob of the present invention taken along line 9—9 in FIG. 1. The parking time indicator key fob 10 includes a main body member 16 in the shape of a parking meter and a window or display 14. The parking time indicator key fob 10 includes a dial central body member 12. The dial central body member 12 is connected internally to a timing device 36, as shown in FIGS. 5 and 6. The dial grip body member 24 is connected to the dial central body member 12 to allow a user to manipulate the dial and therefore the timing mechanism contained therein. An indicator pin 22 is connected internally to the timing device, as shown in FIGS. 5 and 6. Preferably, the user manipulates the dial grip body member 24 to set the parking time indicator key fob 10 at a time value equal to the time remaining on the parking meter 49, as shown in FIG. 8. Upon manipulating the dial grip body member 24, the timing mechanism is activated. When the timing mechanism reaches a predetermined level, an alarm mechanism is sounded, thereby reminding the user that the parking meter at which he parked the car is about to expire, and that additional coins should be inserted to avoid a parking violation.

Figure 10:
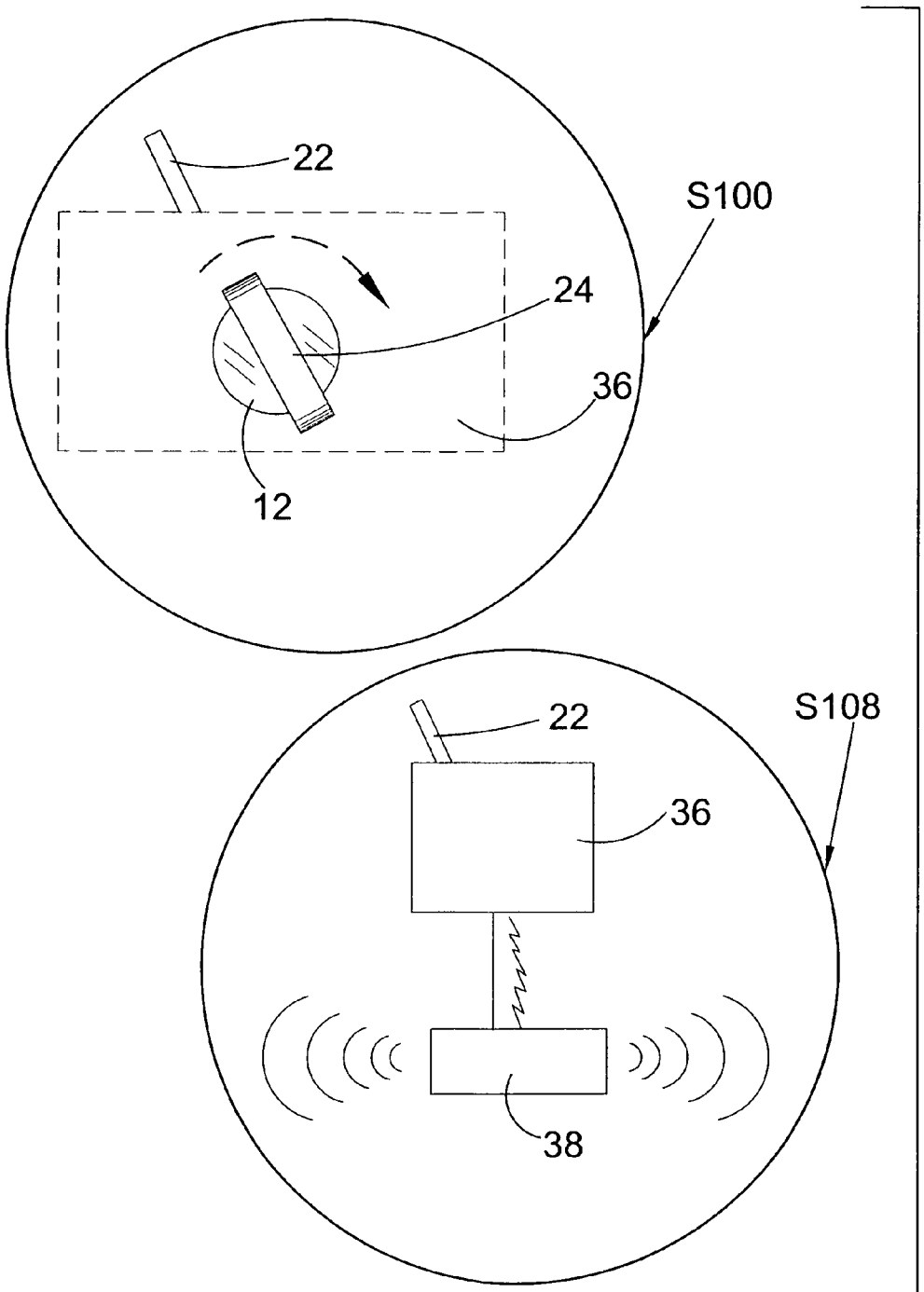
FIG. 10 is an illustration of use of the parking time indicator key fob.

FIG. 10 is an illustration of use of the parking time indicator key fob 10 of the present invention. A dial central body member 12 is connected internally to a timing device 36. The dial grip body member 24 is connected to the dial central body member 12 to allow a user to manipulate the dial and therefore the timing mechanism contained therein. An indicator pin 22 is connected internally to the timing device, as shown in FIGS. 5 and 6. Preferably, the user manipulates the dial grip body member 24 to set the parking time indicator key fob 10 to a desired value, as shown in step S100. Upon manipulating the dial grip body member 24, the timing device 36 is activated. Upon the timing device 36 reaching a predetermined level, an alarm mechanism 38 is activated, as shown in step S1108. Preferably, the alarm is at least one of audio, visual, and vibrational. The alarm reminds the user that the parking meter at which he parked the car is about to expire, and that additional coins should be inserted to avoid a parking violation.

The preceding discussion describes in detail one embodiment of the invention. This discussion should not be construed, however, as limiting the invention to those particular embodiments; practitioners skilled in the art will recognize numerous other embodiments as well. For definition of the complete scope of the invention, the reader is directed to appended claims.

What is claimed is new and desired to be protected by Letters Patent is set forth in the appended claims:

1. A parking time indicator key fob comprising:

a) a housing in the shape of a parking meter having an oval upper section and a narrower main body member extending downwardly from said upper section;

b) a timing device contained within said housing for counting down time set on a parking meter;

c) a display in said oval upper section to for indicating time remaining on said timing device, said display in the shape of an arc with gradations of minutes and hours;

d) a dial on an upper end of said main body member for setting said timing device to said time set on said parking meter said timing device being connected to an indicator pin which is positioned on said display to said time set on said parking meter, said indicator pin sweeping across said display as time elapses;

e) an alarm mechanism connected to said timing device, wherein upon setting said dial to amount time set on said parking meter, said timing device is activated causing said timing device to count down from said time set value to a zero value, and upon reaching a predetermined value, said timing device causes said alarm mechanism to be activated thereby alerting a user that time remaining on said display is approaching said zero value; and f) a chain connected at one end to a lower end of said main body member, an opposite end of said chain being connected to a key ring.

2. The parking time indicator key fob as recited in claim 1, wherein said display includes a window connected over said display and to said housing.

3. The parking time indicator key fob as recited in claim 2, wherein said display includes a digital screen.

4. The parking time indicator key fob as recited in claim 3, wherein said digital screen displays the time set by said dial through said timing device.

5. The parking time indicator key fob as recited in claim 4, wherein said alarm mechanism comprises at least one of an audible alarm, visual alarm, and vibrational alarm.

6. A parking time indicator key fob comprising:

a) a housing in the shape of a parking meter having an oval upper section and a narrower main body member extending downwardly from said upper section;

b) a timing device contained within said housing for counting down time set on a parking meter;

c) a display in said oval upper section for indicating time remaining on said timing device, said display in the shape of an arc with gradations of minutes and hours;

d) a row of control buttons on an upper end of said main body member for setting said timing device to said time set on said parking meter, said control buttons comprising an hour button, a minute button, a set button, and a stop button for controlling said timing device, said timing device being connected to an indicator pin which is positioned on said display to said time set on said parking meter, said indicator pin sweeping across said display as time elapses;

e) an alarm mechanism connected to said timing device, wherein upon setting said timing device to time set on said parking meters said timing device is activated causing said timing device to count down from said time set to a zero value, and upon reaching a predetermined value, said timing device causes said alarm mechanism to be activated thereby alerting a user that time remaining on said display is approaching said zero value;

f) a digital screen in said display, said timing device setting the time in said digital screen at the same time said indicator pin is set; and g) a chain connected at one end to a lower end of said main body member, an opposite end of said chain being connected to a key ring.

* * * * *